US008777378B2

(12) United States Patent
Lee et al.

(10) Patent No.: US 8,777,378 B2
(45) Date of Patent: Jul. 15, 2014

(54) PIEZOELECTRIC ACTUATOR, INKJET HEAD ASSEMBLY AND METHOD OF MANUFACTURING THE SAME

(75) Inventors: Tae Kyung Lee, Gyunggi-do (KR); Pil Joong Kang, Gyunggi-do (KR); Hwa Sun Lee, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 72 days.

(21) Appl. No.: 13/407,331

(22) Filed: Feb. 28, 2012

(65) Prior Publication Data

US 2013/0135399 A1 May 30, 2013

(30) Foreign Application Priority Data

Nov. 30, 2011 (KR) ..... 10-2011-0126592

(51) Int. Cl.
*B41J 2/045* (2006.01)

(52) U.S. Cl.
USPC ..... 347/68

(58) Field of Classification Search
None
See application file for complete search history.

(56) References Cited

U.S. PATENT DOCUMENTS

2004/0246313 A1 12/2004 Lim et al.
2006/0244343 A1* 11/2006 Sugahara ..... 310/341
2010/0146756 A1* 6/2010 Lee et al. ..... 29/25.35

FOREIGN PATENT DOCUMENTS

KR 10-2004-0082740 9/2004
KR 10-2007-0083030 8/2007

* cited by examiner

*Primary Examiner* — Matthew Luu
*Assistant Examiner* — Erica Lin

(57) ABSTRACT

There are provided a piezoelectric actuator, an inkjet head assembly, and a method of manufacturing the same. The piezoelectric actuator includes: upper and lower electrodes providing driving voltage; and a piezoelectric substance formed between the upper and lower electrodes through solidifying a liquid piezoelectric substance, and providing driving force to ink in each of a plurality of pressure chambers provided in an inkjet head, wherein the piezoelectric substance includes a plurality of branch portions individually provided on an upper portion of each of the plurality of pressure chambers and a large area portion integrally provided while being connected to each of the plurality of branch portions at one ends of the plurality of branch portions.

14 Claims, 8 Drawing Sheets

PIEZOELECTRIC ACTUATOR, INKJET HEAD ASSEMBLY AND METHOD OF MANUFACTURING THE SAME

CROSS-REFERENCE TO RELATED APPLICATIONS

This application claims the priority of Korean Patent Application No. 10-2011-0126592 filed on Nov. 30, 2011, in the Korean Intellectual Property Office, the disclosure of which is incorporated herein by reference.

BACKGROUND OF THE INVENTION

1. Field of the Invention

The present invention relates to a piezoelectric actuator, an inkjet head assembly, and a method of manufacturing the same.

2. Description of the Related Art

In general, an inkjet head is a structure converting electrical energy into physical force to thereby discharge ink in droplet form through a small nozzle. Inkjet heads may be mainly divided into two types, according to the ink discharge scheme. One of the two types is a thermal inkjet head, generating bubbles in ink using a heat source and discharging the ink by the expansive force of the bubbles, while the other thereof is a piezoelectric inkjet head using a piezoelectric substance and discharging ink by pressure applied to the ink due to deformation of the piezoelectric substance.

In particular, the piezoelectric inkjet head has recently been widely used in industrial inkjet printers. For example, the piezoelectric inkjet head is used to spray ink produced by melting a metal such as gold, silver, or the like, onto a flexible printed circuit board (FPCB) to thereby directly form a circuit pattern thereon, or has been used in creating industrial graphics, a liquid crystal display (LCD) or an organic light emitting diode (OLED), a solar cell, and the like.

The piezoelectric inkjet head has a structure in which a piezoelectric actuator is provided on an upper portion of an inkjet head plate including a pressure chamber to thereby apply pressure to ink stored in the pressure chamber. Therefore, an electrode wiring needs to be connected to a driving electrode of the piezoelectric actuator to thereby supply voltage thereto.

However, in general, in the piezoelectric actuator, a liquid piezoelectric substance is applied in paste form, solidified, and then used. Therefore, when a piezoelectric substance is formed to have a shape corresponding to that of the pressure chamber formed to be elongated in a length direction, an upper portion of the piezoelectric substance does not have a flat shape, but is formed to be rounded in a width direction to thereby have an arched shape. Therefore, the driving electrode formed on the upper portion of the piezoelectric substance also has a rounded shape.

Even in the case that the driving electrode has the rounded shape, there may be no problem in the performance of the actuator itself. However, the driving electrode to be connected to a flexible printed circuit in order to receive power may also have a rounded shape, such that it maybe difficult to perform soldering or the like thereon. In addition, even in the case that the driving electrode is connected to the flexible printed circuit, a defect such as short-circuit, or the like, may be generated therein.

SUMMARY OF THE INVENTION

An aspect of the present invention provides a piezoelectric actuator including a flat driving electrode such that the driving electrode may be accurately and firmly connected to a flexible printed circuit, even in the case of the inclusion of piezoelectric substances, so as to correspond to each pressure chamber.

According to an aspect of the present invention, there is provided a piezoelectric actuator including: upper and lower electrodes providing driving voltage; and a piezoelectric substance formed between the upper and lower electrodes through solidifying a liquid piezoelectric substance, and providing driving force to ink in each of a plurality of pressure chambers provided in an inkjet head, wherein the piezoelectric substance includes a plurality of branch portions individually provided on an upper portion of each of the plurality of pressure chambers and a large area portion integrally provided while being connected to each of the plurality of branch portions at one ends of the plurality of branch portions.

The upper electrodes may be individually provided to be extended from the branch portions to the large area portion.

The upper electrodes may include connection portions provided in portions thereof positioned on an upper portion of the large area portion, the connection portions having a wider width than that of other portions so as to facilitate an electrical wiring for applying voltage to the upper electrodes.

The connection portions may be provided in different positions in the plurality of upper electrodes in a length direction.

The connection portions may be provided to be disposed in a zigzag form in the plurality of upper electrodes.

An upper portion of the large area portion may have a plane shape.

According to another aspect of the present invention, there is provided an inkjet head assembly including: an inkjet head plate having ink channels formed therein; and a piezoelectric actuator formed to correspond to pressure chambers in the inkjet head plate and providing driving force for discharging ink from the pressure chambers to nozzles, wherein the piezoelectric actuator includes upper and lower electrodes providing driving voltage; and a piezoelectric substance formed between the upper and lower electrodes through solidifying a liquid piezoelectric substance, and providing driving force to ink in each of a plurality of pressure chambers provided in an inkjet head, and the piezoelectric substance includes a plurality of branch portions individually provided on an upper portion of each of the plurality of pressure chambers and a large area portion integrally provided while being connected to each of the plurality of branch portions at one ends of the plurality of branch portions.

The upper electrodes may be individually provided to be extended from the branch portions to the large area portion.

The upper electrodes may include connection portions provided in portions thereof positioned on an upper portion of the large area portion, the connection portions having a wider width than that of other portions so as to facilitate an electrical wiring for applying voltage to the upper electrodes.

The connection portions may be provided in different positions in the plurality of upper electrodes in a length direction.

The connection portions may be provided to be disposed in a zigzag form in the plurality of upper electrodes.

The inkjet head assembly may further include a package part stacked on the inkjet head plate and having a channel formed therein in order to move ink introduced from the outside to an inlet of the inkjet head plate; and an electrical connection portion filled in a via penetrating through the package part, and electrically connected to the upper electrodes of the piezoelectric actuator.

The inkjet head assembly may further include a connection member electrically connecting the electrical connection part and the upper electrodes to each other.

The connection member may be formed of a solder ball.

According to another aspect of the present invention, there is provided a method of manufacturing an inkjet head assembly, the method including: forming ink channels including a plurality of pressure chambers in an inkjet head plate; forming a lower electrode on an upper portion of the inkjet head plate; forming a piezoelectric substance by applying and solidifying a liquid piezoelectric substance such that a plurality of branch portions provided to correspond to each of the plurality of pressure chambers and a large area portion integrally provided while being connected to each of the plurality of branch portions at one ends of the plurality of branch portions are formed on an upper portion of the lower electrode; and forming upper electrodes individually provided to be extended from the branch portions to the large area portion on an upper portion of the piezoelectric substance.

In the forming of the upper electrodes, connection portions may be provided in portions of the upper electrodes positioned on an upper portion of the large area portion, the connection portions having a wider width than that of other portions so as to facilitate an electrical wiring for applying voltage to the upper electrodes.

The connection portions may be provided in different positions in the plurality of upper electrodes in a length direction.

The connection portions may be provided to be disposed in a zigzag form in the plurality of upper electrodes.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
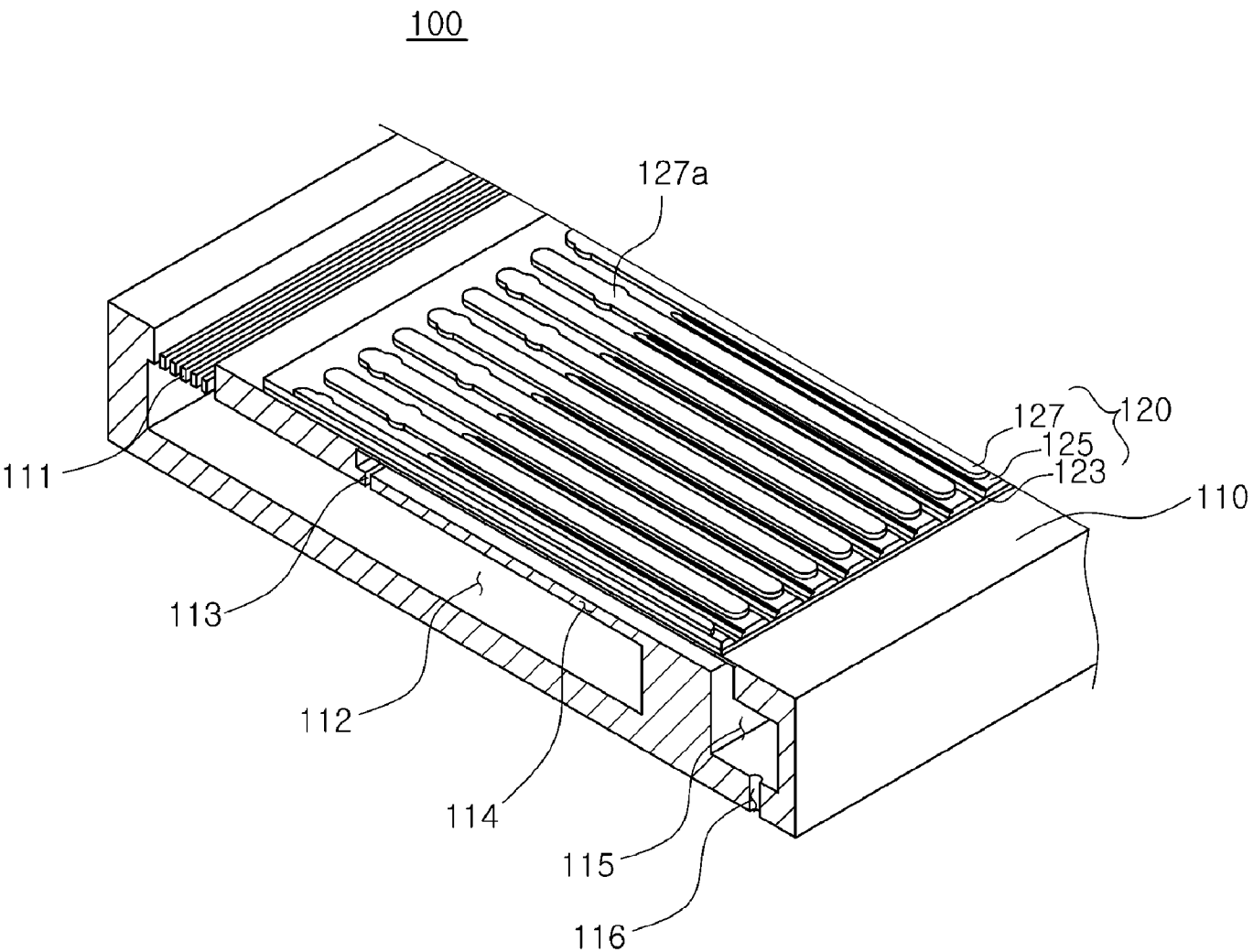
FIG. 1 is a schematic cut-away perspective view showing an inkjet head assembly according to an embodiment of the present invention.

Embodiments of the present invention will now be described in detail with reference to the accompanying drawings. However, it should be noted that the spirit of the present invention is not limited to the embodiments set forth herein and those skilled in the art and understanding the present invention can easily accomplish retrogressive inventions or other embodiments included in the spirit of the present invention by the addition, modification, and removal of components within the same spirit, but those are construed as being included in the spirit of the present invention.

Further, like reference numerals will be used to designate like components having similar functions throughout the drawings within the scope of the present invention.

Figure 2:
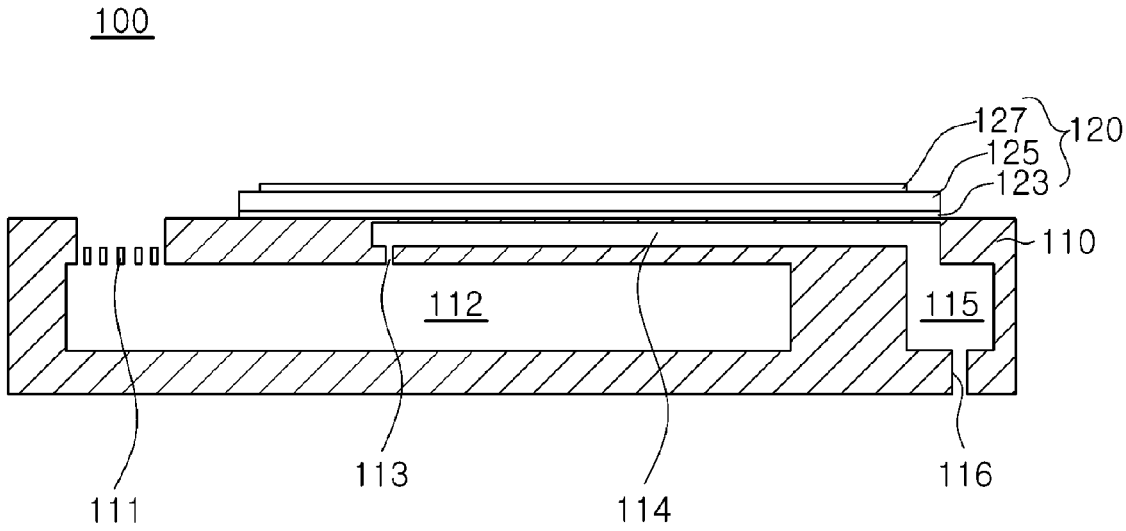
FIG. 2 is a schematic cross-sectional view showing the inkjet head assembly according to the embodiment of the present invention.

FIG. 1 is a schematic cut-away perspective view showing an inkjet head assembly according to an embodiment of the present invention; FIG. 2 is a schematic cross-sectional view showing the inkjet head assembly according to the embodiment of the present invention; and FIG. 3 is a schematic plan view showing the inkjet head assembly according to the embodiment of the present invention.

Figure 3:
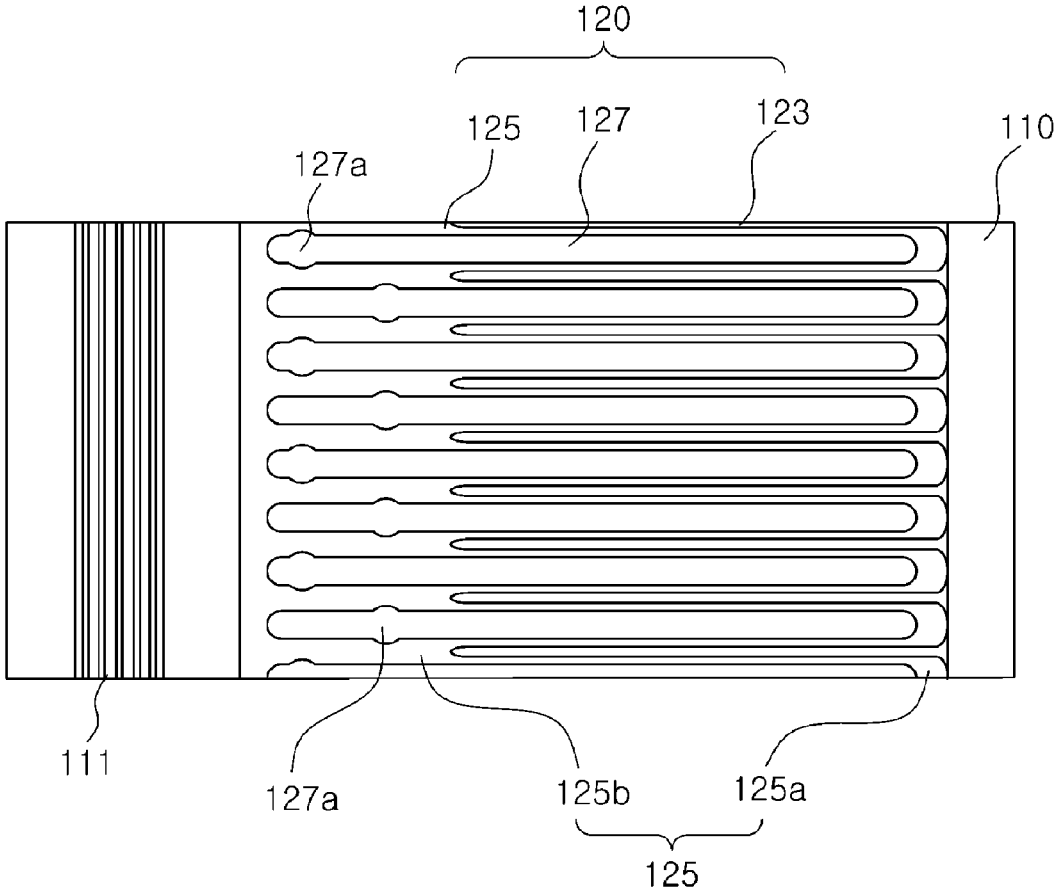
FIG. 3 is a schematic plan view showing the inkjet head assembly according to the embodiment of the present invention.

Referring to FIGS. 1 through 3, an inkjet head assembly 100 according to the embodiment of the present invention may include an inkjet head plate 110 having ink channels formed therein and a piezoelectric actuator 120 providing driving force for discharging ink to the inkjet head plate 110.

The inkjet head plate 110 may include an ink inlet 111 into which ink is introduced, a reservoir 112 storing the ink introduced into the ink inlet 111, a plurality of pressure chambers 114 provided under a position at which the piezoelectric actuator 120 is mounted, and a plurality of nozzles 116 discharging the ink. A plurality of restrictors 113 may be provided between the reservoir 112 and the pressure chambers 114 in order to restrict ink in the pressure chambers 114 from flowing backwardly to the reservoir 112 when the ink is discharged. In addition, the pressure chambers 114 and the nozzles 116 may be connected to each other by a plurality of dampers 115.

The inkjet head assembly 110 may be formed by appropriately configuring components forming the ink channels on upper and lower substrates and bonding the upper and lower substrates to each other by a method such as a silicon direct bonding (SDB) method, or the like. Here, the upper substrate may be a single crystalline silicon substrate or a silicon on insulator (SOI) substrate, and the lower substrate may be an SOI substrate. In addition, the inkjet head plate 110 is not limited thereto. That is, the ink channels may be configured by using more substrates and be implemented using a single substrate in some cases. The components forming the ink channels also are only examples, and ink channels having various configurations may be provided according to requirements and design specifications.

The piezoelectric actuator 120 may be formed on an upper portion of the inkjet head plate 110 so as to correspond to the pressure chambers 114 of the inkjet head plate 110 and provide driving force for discharging the ink introduced into the pressure chambers 114 to the nozzles 116. For example, the piezoelectric actuator 120 may include a lower electrode 123 serving as a common electrode, a piezoelectric film 125 (or a piezoelectric substance) deformed according to application of voltage, and a plurality of upper electrodes 127 serving as driving electrodes.

The lower electrode 123 may be formed over the entire surface of the inkjet head plate 110 and may be formed of a single conductive metal. However, the lower electrode 123 may include two metal thin film layers each made of titanium (Ti) and platinum (Pt). The lower electrode 123 may serve as a diffusion preventing layer preventing mutual diffusion between the piezoelectric film (or the piezoelectric substance) 125 and the inkjet head plate 110, as well as serving as the common electrode.

The piezoelectric film (or the piezoelectric substance) 125 may be formed on the lower electrode 123, may be formed by solidifying a liquid piezoelectric substance in a paste state, and may include a plurality of branch portions 125*a* individually provided on upper portions of the plurality of respective pressure chambers 114 and a large area portion 125*b* integrally provided while being connected to each of the plurality of branch portions 125*a* at one ends of the plurality of branch portions 125*a*. That is, the piezoelectric film (or the piezoelectric substance) 125 having a generally approximately fork head shape may be formed by applying the liquid piezoelectric substance in a paste state to the individually branched branch portions 125*a* on the upper portions of the pressure chambers 114, applying the liquid piezoelectric substance in a paste state to a portion other than the branch portions 125*a* so as to have a generally connected large area shape, and then solidifying the liquid piezoelectric substance.

In the piezoelectric actuator according to the related art, a liquid piezoelectric substance is applied in a paste form, solidified, and then used. Therefore, when a piezoelectric substance is formed to a shape corresponding to that of the pressure chamber elongated in a length direction, an upper portion of the piezoelectric substance does not have a flat shape, but is formed to be rounded in a width direction to thereby have a rounded shape. Therefore, the driving electrode formed on the upper portion of the piezoelectric substance also has a rounded shape. Even though the driving electrode has the rounded shape, there may be no problem in a role of actuator itself. However, the driving electrode to be connected to a flexible printed circuit in order to receive power has a round shape, such that it is difficult to perform soldering, or the like. In addition, even though the driving electrode is connected to the flexible printed circuit, a defect such as short-circuit, or the like, may be generated.

Therefore, according to the embodiment of the present invention, the large area portion 125*b* may be provided. That is, even though the liquid piezoelectric substance is applied in a paste form, when the liquid piezoelectric substance is applied to a wide area (a large area), the liquid piezoelectric substance is solidified while forming a rounded and stepped shape in an edge portion; however, the liquid piezoelectric substance is solidified while forming a generally flat surface in an upper surface portion. Therefore, the piezoelectric substance that may inevitably have the rounded shape becomes flat, such that the flexible printed circuit may be accurately and firmly connected to the upper electrode (the driving electrode) 127 applied to the upper portion of the piezoelectric substance.

The piezoelectric film 125 may be formed of a piezoelectric material, preferably, a lead zirconate titanate (PZT) ceramic material. In addition, as described above, the piezoelectric film 125 may be formed by applying and solidifying the liquid piezoelectric substance in a paste state.

The upper electrodes 127 may be formed on the piezoelectric film and be formed of at least one selected from a group consisting of Pt, Au, Ag, Ni, Ti, Cu, and the like. Each of the upper electrodes 127 may be individually provided to be extended from the branch portions 125*a* to the large area portion 125*b*. That is, the upper electrodes 127 may not be connected to each other, and the number thereof may correspond to the number of pressure chambers 112 to thereby serve as driving electrodes of the respective pressure chambers 112.

Here, the upper electrodes 127 may include connection portions 127*a* provided in a portion thereof positioned on an upper portion of the large area portion 125*b*, wherein the connection portions 127*a* may have a wider width than that of other portions so as to facilitate an electrical wiring for applying voltage to the upper electrodes 127. The connection portions 127*a* are to more accurately connect the upper electrodes 127 and a flexible printed circuit 165 to each other. That is, a portion in which the upper electrodes 127 and the flexible printed circuit 165 are connected to each other may have a wider connection area.

In addition, the connection portions 127*a* may be provided in different positions in each of the plurality of upper electrodes 127 in a length direction. That is, positions at which the connection positions 127*a* are provided in the respective upper electrodes 127 are different, such that a case in which the upper electrode 127 adjacent to a portion having a wide width is short-circuited may be prevented. More specifically, the connection portions 127*a* may be provided to be disposed in a zigzag form in the plurality of upper electrodes 127.

Figure 4:
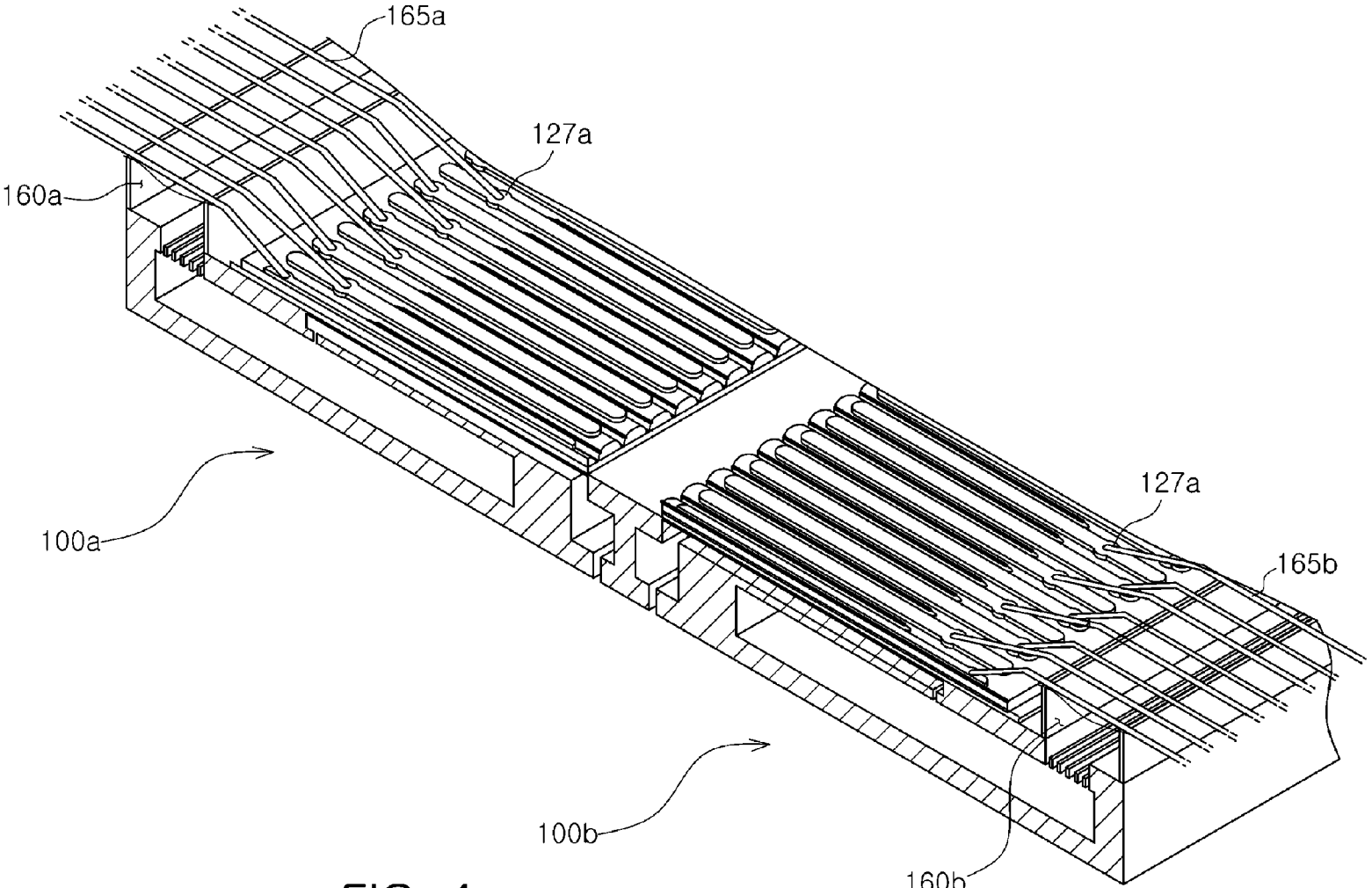
FIG. 4 is a schematic perspective view showing a mounting structure of the inkjet head assembly according to the embodiment of the present invention.

FIG. 4 is a schematic perspective view showing a mounting structure of the inkjet head assembly according to the embodiment of the present invention.

Referring to FIG. 4, amounting structure of the inkjet head assembly according to the embodiment of the present invention may include first and second inkjet head assemblies 100*a* and 100*b* arranged to be symmetrical to each other, ink storage tanks 160*a* and 160*b* disposed on both end portions of the first and second inkjet head assemblies 100*a* and 100*b*, and flexible printed circuits 165*a* and 165*b* connected to upper electrodes of the first and second inkjet head assemblies 100*a* and 100*b*.

In the inkjet head assembly according to the embodiment of the present invention, as described above, the connection portions 127*a* are provided in the upper electrodes, and portions of the piezoelectric substances 125 corresponding to portions in which the flexible printed circuits 165*a* and 165*b* are connected to the upper electrodes 127 are formed to be flat, such that the upper electrodes 127 are provided on the upper portions of the piezoelectric substances 125 so as to be flat, whereby the flexible printed circuits and the upper electrodes may be easily, accurately, and firmly connected to each other.

According the embodiment of the present invention described above, each of two inkjet head assemblies includes a single ink storage tank. As a result, in the case in which each of the two inkjet head assemblies is generally disposed at the left and right sides, two ink storage tanks are necessarily required. Therefore, according to another embodiment of the present invention, an inkjet head assembly 100' including only a single ink storage tank is provided in accordance with the trend toward miniaturization and lightness of the inkjet head assembly.

This corresponds to a configuration in which a package part 130 to be described below is added to the inkjet head plate 110 and the piezoelectric actuator 120 of the inkjet head assembly according to the embodiment of the present invention described above. Therefore, hereinafter, the package part 130 will be described in detail.

Figure 5:
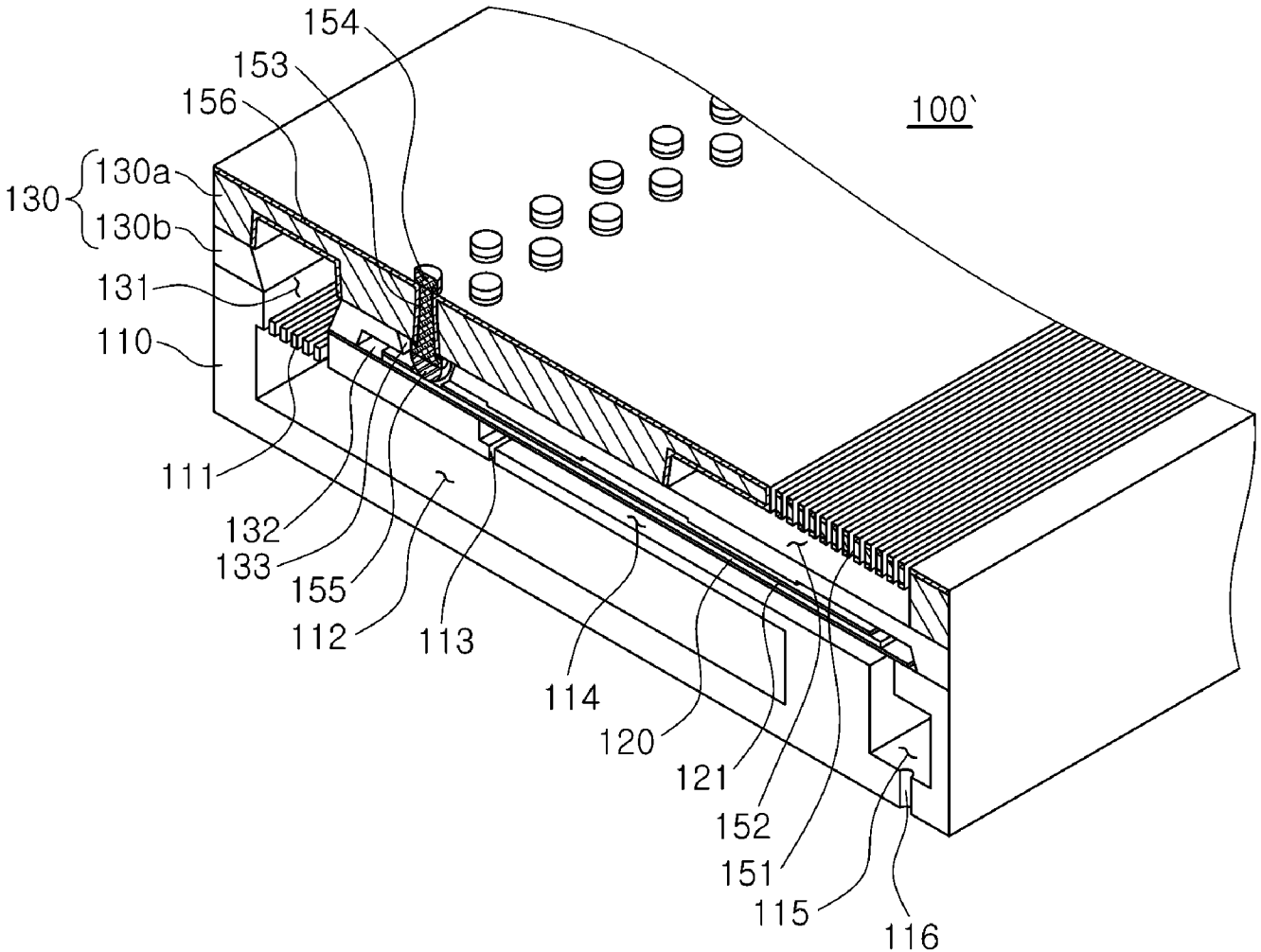
FIG. 5 is a schematic cut-away perspective view showing an inkjet head assembly according to another embodiment of the present invention.
Figure 6:
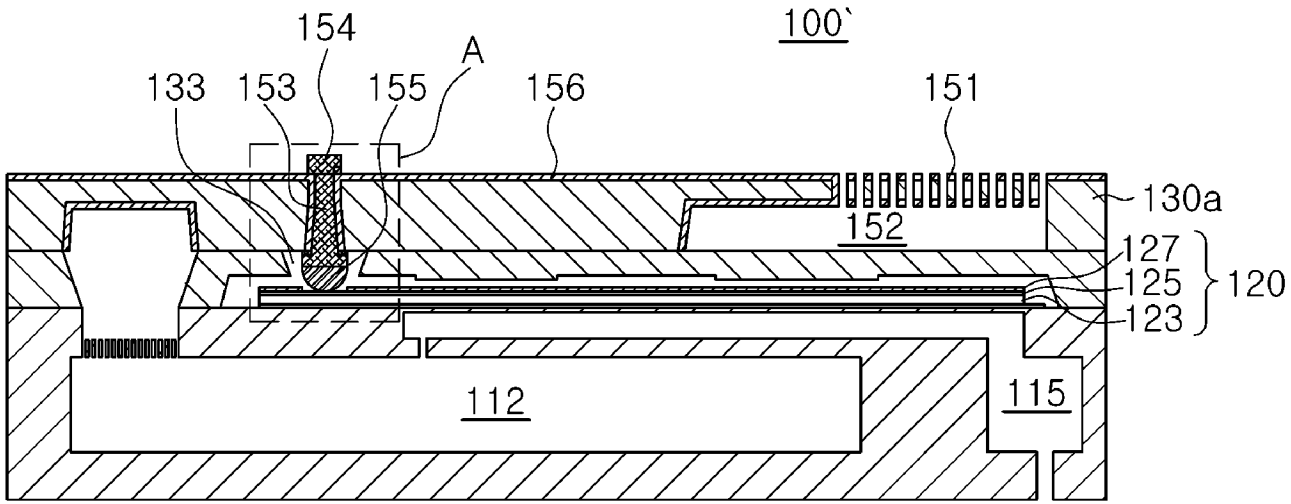
FIG. 6 is a schematic cross-sectional view showing the inkjet head assembly according to another embodiment of the present invention.
Figure 7:
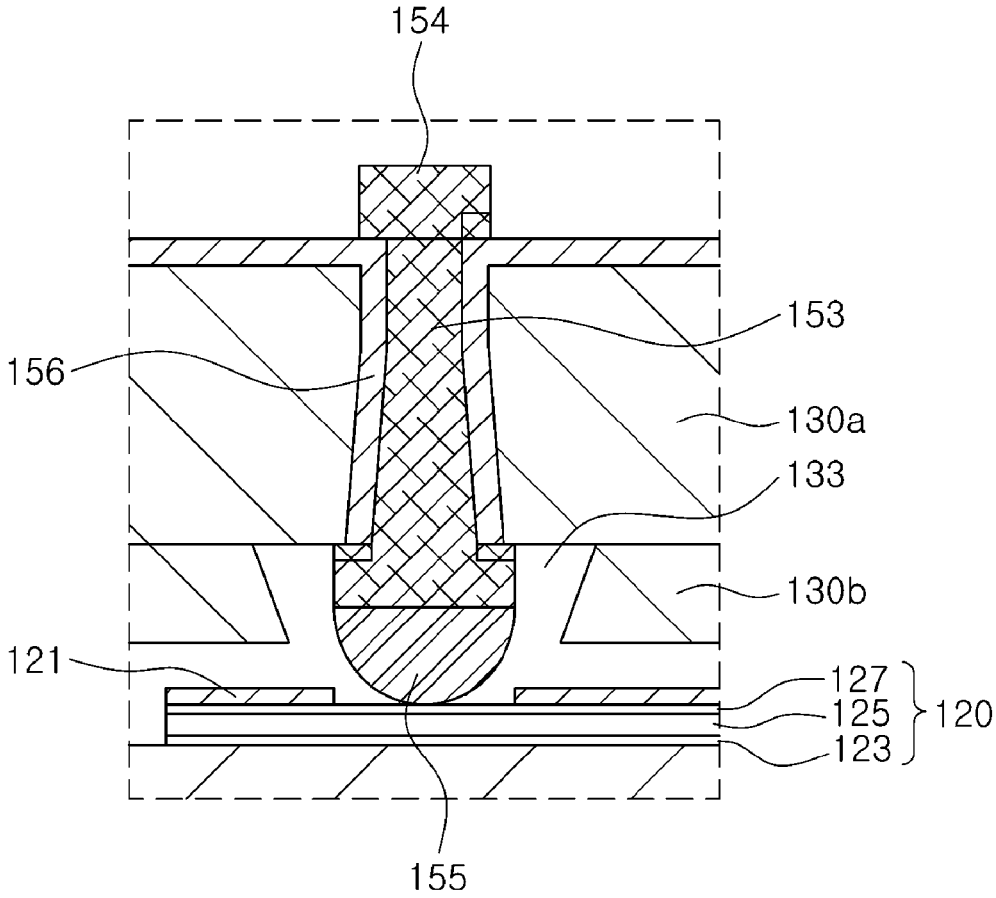
FIG. 7 is a schematic plan view showing the inkjet head assembly according to another embodiment of the present invention.

FIG. 5 is a schematic cut-away perspective view showing an inkjet head assembly according to another embodiment of the present invention. FIG. 6 is a schematic cross-sectional view showing the inkjet head assembly according to another embodiment of the present invention. FIG. 7 is a schematic plan view showing the inkjet head assembly according to another embodiment of the present invention.

Referring to FIGS. 5 through 7, a package part 130 may include a channel forming layer 130*a* in which ink channels for moving ink supplied from the ink storage tank to the ink inlet 111 of the inkjet head plate 110 are formed and an intermediate layer 130*b* for bonding the package part 130 and the inkjet head plate 110 to each other. The package part 130 may be formed of a silicon wafer. In this case, the channel forming layer 130*a* may be formed of a single crystalline silicon wafer, the intermediate layer 130*b* may be formed of a glass wafer, and the channel forming layer 130*a* and the intermediate layer 130*b* may be bonded to each other by anodic bonding, glass frit bonding, or the like.

The configuration of the package part 130 according to another embodiment of the present invention described above is only an example. That is, the package part 130 may be formed of a single silicon wafer, a silicon wafer including more layers, or an SOI wafer, and may be variously changed in design according to requirements. The configurations of the channel forming layer 130*a* and the intermediate layer 130*b* described above are only an example. That is, the intermediate layer 130*b* may be formed of a silicon wafer, such that the channel forming layer 130*a* and the intermediate layer 130*b* may be bonded to each other by silicon direct bonding. Furthermore, various design changes may be made. For example, the channel forming layer 130*a* and the intermediate layer 130*b* may be bonded to each other by polymer bonding, low temperature silicon direct bonding using plasma, eutectic bonding or the like.

The channel forming layer 130*a* may include an ink inlet 151 into which the ink supplied from the ink storage tank is introduced, an ink transfer part 152 serving as a channel for moving the ink to the inkjet head plate 110, and a via 153 for an electrical wiring applying voltage to the piezoelectric actuator 120. The via 153 may penetrate through upper and lower portions of the channel forming layer 130*a* and be disposed at one side on an upper portion of the piezoelectric actuator 120. In this configuration, the ink inlet 152 may be formed on an opposite side of the via 153. Therefore, in the mounting structure of the inkjet head assembly, the ink storage tank is disposed at a central portion of the inkjet head assembly, and the electrical wiring is connected to a side end portion of the inkjet head assembly, whereby a mounting area of the inkjet head assembly may be reduced.

The ink inlet 151, the ink transfer part 152, and the via 153 may be formed in a silicon wafer by an etching process. Particularly, the via 153 may be formed in a shape of a vertical hole having a constant diameter or in a shape in which a diameter thereof is gradually increased toward a lower portion of the channel forming layer 130*a*, that is, a shape in which a side is inclined, by a dry etching process. The via 153 may be formed by a reactive ion etching (RIE) process, particularly, a deep reactive ion etching (DRIE) process, among several dry etching processes. The via 153 is filled with a metal for an electrical wiring to thereby form an electrical connection portion 154.

The electrical connection portion 154 may be formed by plating a metal in the via 153 by an electroplating method. The metal used in the plating may be at least one of Pt, Au, Ag, Ni, Ti, Cu, and the like. The electrical connection portion 154 is formed such that upper and lower ends thereof are wider than a circumference of the via 153 in order to ensure electrical connection. Therefore, the electrical connection portion 154 may have an I-beam shaped cross section. The electrical connection portion 154 is not limited to have the -beam shaped cross section, but may have a shape such as a 1 shape, a T shape, or the like. In addition, the side of the electrical connection portion 154 may be formed vertically or be inclined, so as to correspond to the shape of the via 153.

The electrical connection portion 154 may include a connection member 155 formed on the lower end thereof so as to be connected to the piezoelectric actuator 120. The connection member 155 may be formed of a conducting medium having bonding force having a level in which an electrical short-circuit is not generated, for example, a protrusion type connection member such as a solder ball, a solder bump, or the like, or anisotropic conductive film (ACF). The connection member 155 may also be formed of various load application conducting medium, in addition to the above-mentioned materials. According to the present embodiment, it is assumed that the solder ball is used as the connection member 155. The connection member 155 may be connected to the connection portion 127*a* of the upper electrode 127 described above.

In order to prevent a phenomenon in which a solder overflows at the time of reflow of the solder for bonding the solder ball 155 to the piezoelectric actuator 120, a polymer film 121 may be applied to the upper surface of the piezoelectric actuator 120. Here, the polymer film 121 may be formed on a portion of an upper surface of the piezoelectric actuator 120, except for a bonded portion of the solder. The polymer film 121 may be formed by developing a material such as a photosensitive polymer, or the like.

The channel forming layer 130*a* may include an oxide film 156 formed on an upper surface thereof, a surface thereof in which the via 153 is formed, and a surface thereof on which the ink transfer part 152 is formed. The oxide film 156 may serve to prevent the diffusion of impurities contained in a silicon crystal of the channel forming layer 130*a* formed of a silicon wafer. The oxide film 156 may be formed by oxidizing silicon of the channel forming layer 130*a* to form an oxide film on a surface of the channel forming layer 130*a* and then removing the oxide film formed on a lower surface of the channel forming layer 130*a* by chemical-mechanical polishing (CMP), or the like.

The intermediate layer 130*b* may include a path 131 supplying the ink in the ink transfer part 152 of the channel forming layer 130*a* to the ink inlet of the inkjet head plate 110, a receiving portion 132 receiving the upper portion of the piezoelectric actuator 120 therein, and a communication hole 133 communicating between the receiving portion 132 and the via 153. The receiving portion 132 of the piezoelectric actuator 120 may be formed of a groove depressed from an upper portion of the intermediate layer 130*b* toward a lower portion thereof, have a shape corresponding to that of the piezoelectric actuator 120, and be formed at a depth corresponding to a value obtained by adding a thickness of the piezoelectric actuator 120 and a machining error to each other. The receiving portion 132 and the communication hole 133 may be formed by performing a sandblast process or an etching process on a glass wafer.

The package part 130 formed by the anodic bonding between the channel forming layer 130*a* and the intermediate layer 130*b* may be stacked on and bonded to the upper surface of the inkjet head plate 110. More specifically, the lower surface of the intermediate layer 130*b* and the upper surface of the inkjet head plate 110 may be bonded to each other by the anodic bonding or glass frit bonding. At this time, the connection member 155 of the electrical connection portion 154 may be bonded to the upper portion of the piezoelectric actuator 120. According to the present embodiment, the bonding between the inkjet head plate 110 and the package part 130 is supported by a bonded portion of an edge portion thereof.

As described above, in the inkjet head assembly 100' according to the embodiment, since the inkjet head plate 110 and the package part 130 may be bonded to each other in a wafer level, improvement of productivity such as an increase in processing yield, a reduction in manufacturing cost, or the like, may be accomplished.

Figure 8:
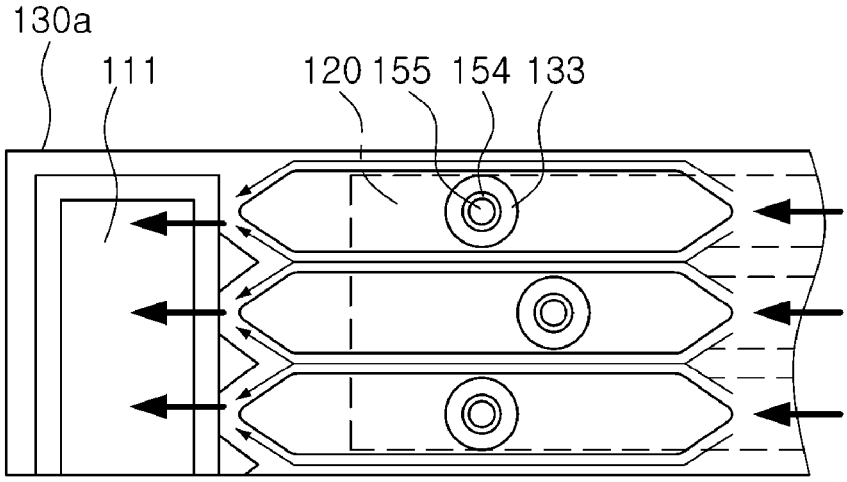
FIG. 8 is a schematic plan view showing an ink channel of a package part of the inkjet head assembly according to another embodiment of the present invention.
Figure 9:
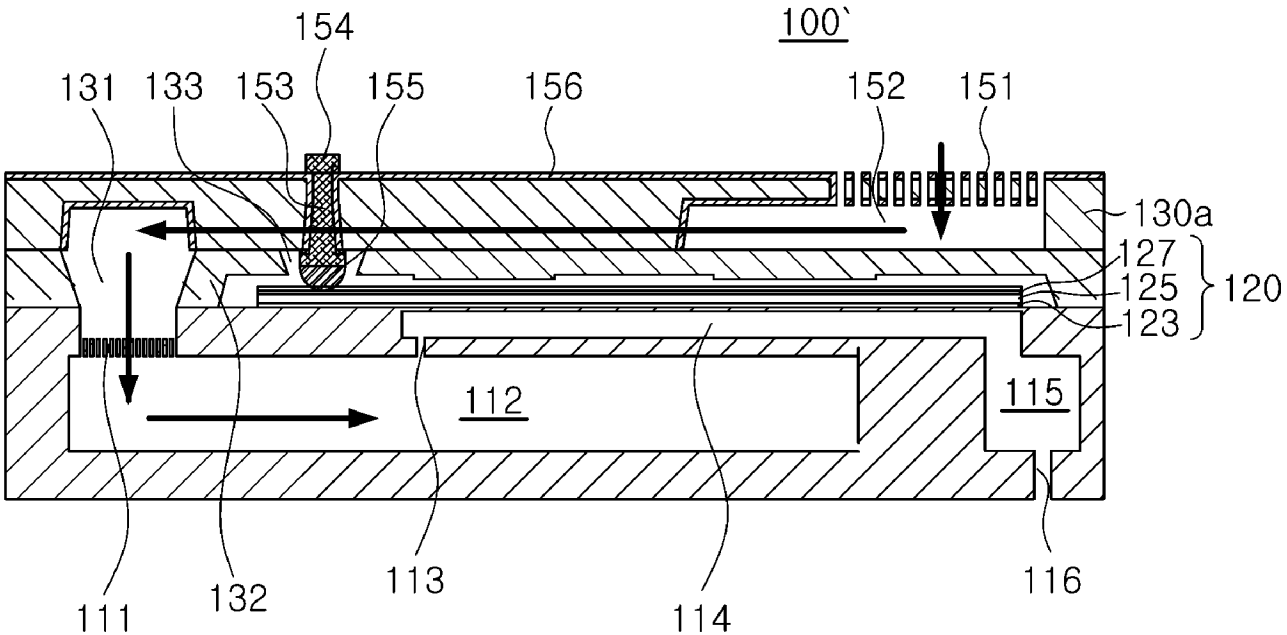
FIG. 9 is a cross-sectional view showing the ink channel of the inkjet head assembly according to another embodiment of the present invention.

FIG. 8 is a schematic plan view showing an ink channel of a package part of the inkjet head assembly according to another embodiment of the present invention. FIG. 9 is a cross-sectional view showing the ink channel of the inkjet head assembly according to another embodiment of the present invention.

Referring to FIGS. 8 and 9, the ink introduced from the ink storage tank (not shown) to the ink inlet 151 is transferred from the ink transfer part 152 in an arrow direction. Then, the ink moves between wall portions between which the via 153 to be filled with the electrical connection portion 154 is formed and then moves from an end portion of the ink transfer part 152 to the ink inlet 111 of the inkjet head plate 110 through the path 131 of the intermediate layer 130*b*.

Although not shown, a movement path of the ink introduced into the inkjet head plate 110 through the ink inlet 111 is substantially the same as an ink movement path in the inkjet head according to the related art. That is, the ink introduced into the ink inlet 111 moves from the reservoir 112 to the pressure chambers 114 through the plurality of restrictors, and the ink in the pressure chambers 114 is discharged from the nozzles 116 to the outside via the plurality of dampers 115 by driving of the piezoelectric actuator 120.

Describing an operation of the inkjet head assembly 100', the ink supplied from the ink storage tank (not shown) through the ink inlet 151 moves in the arrow direction of FIGS. 8 and 9 to thereby be supplied into each of the plurality of pressure chambers 114 of the inkjet head plate 110. When voltage is applied to the piezoelectric actuator 120 through the electrical connection portion 154 connected to a flexible printed circuit board (FPCB) (not shown) in a state in which the ink is filled in the inner portions of the pressure chambers 114, the piezoelectric film is deformed, such that the upper portion of the inkjet head plate 110 serving as a vibration plate may be bent downwardly. Volume of the pressure chambers 114 is reduced due to the bending deformation of the upper portion of the inkjet head plate 110 to increase pressure in the pressure chambers, such that the ink in the pressure chambers 114 may be discharged to the outside through the nozzles 116.

Then, when the voltage applied to the piezoelectric actuator 120 is blocked, the piezoelectric film is restored to its original state, such that the upper portion of the inkjet head plate 110 serving as the vibration plate may be restored to its original state, thereby increasing volume of the pressure chambers 114. Therefore, pressure may be reduced in the pressure chambers 114 and surface tension may be generated by a meniscus of the ink formed in the nozzles 116, such that the ink may be introduced from the reservoir 112 into the pressure chambers 114.

Figure 10:
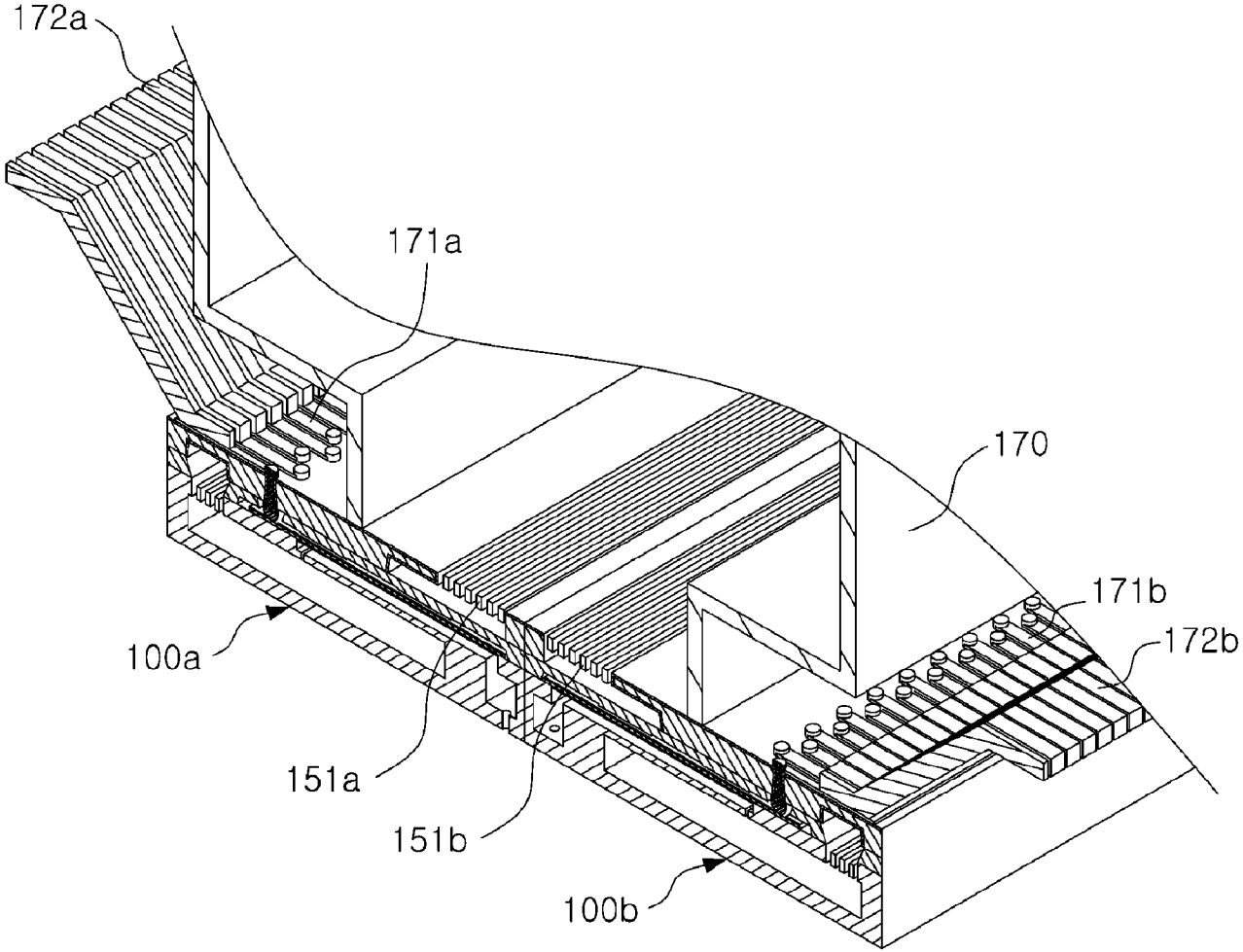
FIG. 10 is a schematic perspective view showing a mounting structure of the inkjet head assembly according to another embodiment of the present invention.

FIG. 10 is a schematic perspective view showing a mounting structure of the inkjet head assembly according to another embodiment of the present invention.

Referring to FIG. 10, the mounting structure of the inkjet head assembly 100' includes first and second inkjet head assemblies 100'*a* and 100'*b* arranged to be symmetrical to each other, an ink storage tank 170 disposed at the center of an upper portion of the first and second inkjet head assemblies 100'*a* and 100'*b*, bonding portions 171*a* and 171*b* each formed on upper surfaces of the first and second inkjet head assemblies 100'*a* and 100'*b* and connected to electrical connection portions 154*a* and 154*b*, and FPCBs 172*a* and 172*b* connected to the bonding portions 171*a* and 171*b* in order to apply voltage to piezoelectric actuators of the first and second inkjet head assemblies 100'*a* and 100'*b*. The bonding portions 171*a* and 171*b* may be formed of an epoxy resin, particularly, an anisotropic conductive film (ACF).

As described above, in the inkjet head assembly according to the embodiment of the present invention, the electrical wiring for applying the voltage to the piezoelectric actuator 120 is connected to the piezoelectric actuator 120 through the electrical connection portion 154 formed almost perpendicularly to the surface of the inkjet head assembly, whereby an area of the inkjet head assembly required for bonding of the FPCB according to the related may be significantly reduced. Therefore, the inkjet head assembly according to the present embodiment has the entire width reduced as compared to the entire width of the inkjet head assembly according to the related art by an area for bonding of the FPCB and an area for bonding of the ACF. In this configuration, since the ink storage tank is disposed at a central portion of an upper portion of a set of inkjet head assemblies having a symmetrical structure in which nozzles are alternately formed, the mounting area of the inkjet head assembly is significantly reduced.

Since the entire width of the inkjet head assemblies formed as a wafer level package is significantly reduced due to the reduction of the mounting area of the inkjet head assembly, more inkjet head assemblies per wafer may be manufactured. Therefore, improvement of productivity such as an increase in processing yield, a reduction in manufacturing cost, or the like, may be accomplished.

Next, a method of manufacturing an inkjet head assembly according to the embodiment of the present invention will be briefly described.

First, ink channels including a plurality of pressure chambers are formed in an inkjet head plate, and a lower electrode is formed on an upper portion of the inkjet head plate. Then, a piezoelectric substance is formed by applying and solidifying a liquid piezoelectric substance liquid in a paste state in order that a plurality of branch portions provided to correspond to each of the plurality of pressure chambers and a large area portion integrally provided while being connected to each of the plurality of branch portions at one ends of the plurality of branch portions are formed on an upper portion of the lower electrode.

Next, upper electrodes individually provided to be extended from the branch portions to the large area portion are formed on an upper portion of the piezoelectric substance, whereby the inkjet head assembly may be manufactured.

In the above-mentioned state, an ink storage tank may be installed, and the upper electrodes, which are driving electrodes, may be connected to a flexible printed circuit for applying voltage in order to operate the piezoelectric actuator.

As set forth above, with the piezoelectric actuator and the inkjet head assembly according to the embodiments of the present invention, a portion in which the external electrode is connected to the flexible printed circuit is formed to be flat, whereby external electrode and the flexible printed circuit may be accurately and firmly connected to each other.

Although the embodiments of the present invention have been described in detail, they are only examples. It will be appreciated by those skilled in the art that various modifications and equivalent other embodiments are possible from the present invention. For example, a method of forming each component of the package part of the inkjet head assembly in the present invention is only an example. Therefore, various etching methods may be applied, and a sequence of operations of the method of manufacturing an inkjet head assembly may be changed from the sequence described above. Accordingly, the actual technical protection scope of the present invention must be determined by the spirit of the appended claims.

What is claimed is:

1. A piezoelectric actuator comprising:

upper and lower electrodes providing driving voltage; and a piezoelectric substance formed between the upper and lower electrodes through solidifying a liquid piezoelectric substance, and providing driving force to ink in each of a plurality of pressure chambers provided in an inkjet head, wherein the piezoelectric substance includes a plurality of branch portions individually provided on an upper portion of each of the plurality of pressure chambers and a large area portion integrally provided while being connected to each of the plurality of branch portions at one ends of the plurality of branch portions.

2. The piezoelectric actuator of claim 1, wherein the upper electrodes are individually provided to be extended from the branch portions to the large area portion.

3. The piezoelectric actuator of claim 2, wherein the upper electrodes include connection portions provided in portions thereof positioned on an upper portion of the large area portion, the connection portions having a wider width than that of other portions so as to facilitate an electrical wiring for applying voltage to the upper electrodes.

4. The piezoelectric actuator of claim 3, wherein the connection portions are provided in different positions in the plurality of upper electrodes in a length direction.

5. The piezoelectric actuator of claim 3, wherein the connection portions are provided to be disposed in a zigzag form in the plurality of upper electrodes.

6. The piezoelectric actuator of claim 1, wherein an upper portion of the large area portion has a plane shape.

7. An inkjet head assembly, comprising:

an inkjet head plate having ink channels formed therein; and a piezoelectric actuator formed to correspond to pressure chambers in the inkjet head plate and providing driving force for discharging ink from the pressure chambers to nozzles, wherein the piezoelectric actuator includes upper and lower electrodes providing driving voltage; and a piezoelectric substance formed between the upper and lower electrodes through solidifying a liquid piezoelectric substance, and providing driving force to ink in each of a plurality of pressure chambers provided in an inkjet head, and the piezoelectric substance includes a plurality of branch portions individually provided on an upper portion of each of the plurality of pressure chambers and a large area portion integrally provided while being connected to each of the plurality of branch portions at one ends of the plurality of branch portions.

8. The inkjet head assembly of claim 7, wherein the upper electrodes are individually provided to be extended from the branch portions to the large area portion.

9. The inkjet head assembly of claim 8, wherein the upper electrodes include connection portions provided in portions thereof positioned on an upper portion of the large area portion, the connection portions having a wider width than that of other portions so as to facilitate an electrical wiring for applying voltage to the upper electrodes.

10. The inkjet head assembly of claim 9, wherein the connection portions are provided in different positions in the plurality of upper electrodes in a length direction.

11. The inkjet head assembly of claim 9, wherein the connection portions are provided to be disposed in a zigzag form in the plurality of upper electrodes.

12. The inkjet head assembly of claim 7, further comprising a package part stacked on the inkjet head plate and having a channel formed therein in order to move ink introduced from the outside to an inlet of the inkjet head plate; and an electrical connection portion filled in a via penetrating through the package part, and electrically connected to the upper electrodes of the piezoelectric actuator.

13. The inkjet head assembly of claim 12, further comprising a connection member electrically connecting the electrical connection part and the upper electrodes to each other.

14. The inkjet head assembly of claim 13, wherein the connection member is formed of a solder ball.

* * * * *